US007969404B2

(12) United States Patent
Lee et al.

(10) Patent No.: US 7,969,404 B2
(45) Date of Patent: Jun. 28, 2011

(54) DEVICE FOR DRIVING A BACKLIGHT, BACKLIGHT ASSEMBLY, LCD APPARATUS HAVING THE SAME AND METHOD FOR DRIVING A BACKLIGHT

(75) Inventors: Sang-Gil Lee, Seoul (KR); Hyeon-Yong Jang, Osan-si (KR); Mun-Soo Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 731 days.

(21) Appl. No.: 11/552,544

(22) Filed: Oct. 25, 2006

(65) Prior Publication Data

US 2007/0091057 A1 Apr. 26, 2007

(30) Foreign Application Priority Data

Oct. 26, 2005 (KR) ..... 10-2005-101132

(51) Int. Cl.
*G09G 3/36* (2006.01)

(52) U.S. Cl. ..... 345/102; 345/84; 345/87

(58) Field of Classification Search ..... 345/55, 345/76, 77, 84, 87, 88, 102, 204, 690
See application file for complete search history.

(56) References Cited

U.S. PATENT DOCUMENTS 6,069,676 A 5/2000 Yuyama
6,608,614 B1 * 8/2003 Johnson ..... 345/102
6,888,529 B2 * 5/2005 Bruning et al. ..... 345/102
7,002,547 B2 * 2/2006 Yamada ..... 345/102
7,460,103 B2 * 12/2008 Konno et al. ..... 345/102
2003/0169226 A1 * 9/2003 Yamada ..... 345/102
2005/0184952 A1 * 8/2005 Konno et al. ..... 345/102

OTHER PUBLICATIONS

European Search Report for Application No. 06022278.3-2205/1780701 dated Jun. 23, 2009.
European Examination Report for Application No. 06 022 278.3-2205 dated Mar. 5, 2010.

* cited by examiner

*Primary Examiner* — My-Chau T Tran
(74) *Attorney, Agent, or Firm* — Cantor Colburn LLP

(57) ABSTRACT

A liquid crystal display apparatus includes a backlight assembly which includes a device for driving the backlight including a light emitting diode ("LED") used as a light source, which has a high efficiency and a high reliability for controlling brightness of each color light. The driving device drives a first, second and third LED unit emitting a first, second and third light, respectively. The driving device includes a first driving part emitting the first light in response to a brightness control signal and outputting a reference control signal in response to a first brightness of the first light, a second driving part driving the second LED units generating the second light of which second brightness is controlled in response to the reference control signal, and a third driving part driving the third LED units generating the third light of which third brightness is controlled in response to the reference control signal.

8 Claims, 8 Drawing Sheets

FIG. 6

| SDM [V] | BRIGHTNESS [nit] | Ir1 [mA] | Ir2 [mA] | Ir3 [mA] | WHITE CHROMATICITY COORDINATES | |
|---|---|---|---|---|---|---|
| | | | | | X-COORDINATE | Y-COORDINATE |
| 0 | 82.4 | 29 | 40 | 24 | 0.325 | 0.356 |
| 1 | 132 | 44 | 57 | 36 | 0.330 | 0.352 |
| 2 | 179 | 59 | 73 | 47 | 0.332 | 0.351 |
| 3 | 226 | 74 | 91 | 59 | 0.333 | 0.351 |
| 4 | 271 | 89 | 110 | 71 | 0.333 | 0.351 |

FIG. 7

| | NORMAL TEMPERATURE 25℃ | | HIGH TEMPERATURE 50℃ | |
|---|---|---|---|---|
| | CURRENT CONTROL METHOD | VOLTAGE CONTROL METHOD | CURRENT CONTROL METHOD | VOLTAGE CONTROL METHOD |
| CONSUMPTION POWER [W] | 50 | 88.9 | 49.9 | 93 |
| LED BAR[℃] | 51.8 | 63.7 | 74.2 | 80.2 |
| OUTSIDE OF PANEL [℃] | 43.1 | 47.7 | 59 | 61.3 |
| INSIDE OF PANEL [℃] | 45.8 | 48.6 | 61 | 63.2 |
| REAR FACE OF B/L [℃] | 50.4 | 54.4 | 67.6 | 70.5 |
| BRIGHTNESS [nit] | 260 | 255 | 215 | 222 |

DEVICE FOR DRIVING A BACKLIGHT, BACKLIGHT ASSEMBLY, LCD APPARATUS HAVING THE SAME AND METHOD FOR DRIVING A BACKLIGHT

This application claims priority to Korean Patent Application No. 2005-101132, filed on Oct. 26, 2005, and all the benefits accruing therefrom under 35 U.S.C. §119, the contents of which in its entirety are herein incorporated by reference.

BACKGROUND OF THE INVENTION

1. Field of the Invention

Exemplary embodiments of the present invention relate to a device for driving a backlight, a backlight assembly, a liquid crystal display ("LCD") apparatus having the backlight assembly and a method for driving a backlight. More particularly, exemplary embodiments of the present invention relate to a device for driving a backlight, which uses a light emitting diode ("LED") as a light source, having a high efficiency and a high reliability for controlling the brightness of each color light source, a backlight assembly, an LCD apparatus utilizing the backlight assembly and a method for driving a backlight.

2. Description of the Related Art

A flat panel type display device is becoming more widely used because of its relatively small size and light weight. Additionally, the flat panel type display device has an advantage in that it can realize high-resolution images.

Currently, a liquid crystal display ("LCD") apparatus is the most widely used flat panel display device. The LCD apparatus may be defined as a display device displaying images using liquid crystal in which light transmission is changed according to an electric field. The LCD apparatus is relatively thinner and lighter than other display devices. Additionally, the LCD apparatus has a relatively lower driving voltage and a relatively lower power consumption than other display devices so that the LCD apparatus is widely used in notebook computers, mobile terminals, etc. The typical LCD apparatus includes an LCD panel assembly and a backlight assembly.

The LCD panel assembly includes an LCD panel. The LCD panel includes a thin film transistor ("TFT") substrate, a color filter substrate facing the TFT substrate, and a liquid crystal layer interposed between the TFT substrate and the color filter substrate which changes the light transmissivity throughout the layer in response to applied electrical signals.

The backlight assembly includes a light source for generating light and optical members for improving brightness characteristics of light projected from the light source.

A cold cathode fluorescent lamp ("CCFL") is generally used as the light source. Alternatively, a light emitting diode ("LED") may be used as the light source. LEDs have the advantage of having superior color reproducibility compared to CCFLs.

An LED is a point light source which has a smaller light emitting area than a CCFL. Light projected from the LED light source is incident to a side portion of a light guide plate of the optical members which guides a path of the light. The light guide plate changes the path of the light exiting from the LED light source so that the light may be akin to light emitted from a surface light source, which is better suited to supply the light to the LCD panel.

Generally, in order to represent natural color, the LED light source uses a method of uniformly adjusting white chromaticity coordinates of the light emitted from the light source. It does so by controlling the brightness of three kinds of LEDs, e.g., a red LED, a green LED and a blue LED. In the above-mentioned method, the brightness of light projected from the backlight and the white chromaticity coordinates of the backlight have to be adjusted by controlling the brightness of each of the three separately colored LEDs, respectively. Generally, in order to control the brightness and therefore the white chromaticity of the LEDs, a voltage control method has been used in which a constant voltage is applied to each of the LEDs for a controlled time period.

However, the above-mentioned voltage control method applies the constant voltage to the LED via electric power supplied to the LED by modulating a pulse width of the constant voltage to control a time period for lightning the LED.

The LED in a LED light source is not constantly on. Rather, the LED blinks on and off at a rapid frequency which the human eye interprets as a constant light. Light sources utilizing LEDs may take advantage of this feature to create lights with the ability to dim or brighten. LED light sources may create the impression of dimming by increasing the time span between on and off periods and they may conversely create the appearance of brightening by decreasing the time span between on and off periods.

All LEDs have a limited lifetime, but rather than failing catastrophically as is the case in incandescent or fluorescent lighting, the LED gradually reduces the amount of light output for a given input voltage due to heating and degradation of the LED pn-junction. In order to compensate for this dimming, backlights using the voltage control method increase the pulse widths of the constant voltage supplied to the LED, thereby lighting the LED for longer periods of time and consuming more power. Essentially, to create the same brightness, the LED is turned off for shorter and shorter periods of time. The LED therefore has less time to cool between on cycles, which eventually causes the pn-junction of the LED to degrade further. The backlight using the voltage control method then must use even more power to generate even longer pulse widths and the problem compounds itself.

Another consequence of the LED light source consuming more power is that the associated heat generation effects elements of a driving board and decreases the efficiency of the driving board on which the elements are mounted. Accordingly, when the LED light source is driven by the voltage control method, a means for heat protection, such as a heat protection plate of graphite or aluminum is additionally required and thus manufacturing costs of the LCD apparatus increase.

BRIEF SUMMARY OF THE INVENTION

Exemplary embodiments of the present invention provide a device for driving a backlight, which uses an LED as a light source, having a high efficiency and a high reliability for controlling the brightness of each color light using a constant current.

Exemplary embodiments of the present invention provide a backlight assembly having the above driving device.

Exemplary embodiments of the present invention provide an LCD apparatus having the above-described backlight assembly.

Exemplary embodiments of the present invention provide a method for driving a backlight by which the backlight has a high efficiency and a high reliability for controlling the brightness of light using a constant current.

According to one exemplary embodiment of the present invention, there is provided a device for driving a backlight, the device driving a first LED unit, a second LED unit and a third LED unit emitting a first light, a second light and a third light, respectively. The first, second and third lights generates white light when mixed together. The driving device for the backlight includes a first driving part, a second driving part and a third driving part. The first driving part drives the first light emitting diode unit such that the first light emitting diode unit emits the first light in response to a brightness control signal, and outputs a reference control signal in response to a first brightness of the first light. The second driving part drives the second light emitting diode unit such that the second light emitting diode unit emits the second light of which a second brightness is controlled in response to the reference control signal for generating white light. The third driving part drives the third light emitting diode unit such that the third light emitting diode unit emits the third light of which a third brightness is controlled in response to the reference control signal for generating white light.

In an exemplary embodiment of the present invention, the first driving part may include a first constant current circuit supplying a first constant current having a first constant level to the first LED unit in response to the brightness control signal and a first feedback signal generated by a voltage applied to both ends of the first LED unit, and a first color sensing unit measuring the first brightness of the first light emitted in the first LED unit and may outputting the reference control signal.

In an exemplary embodiment of the present invention, the second driving part may include a first signal handling unit outputting a first white control signal in response to the reference control signal, a second constant current circuit outputting a second constant current having a second constant level in response to the first white control signal and maintaining the second constant level of the second constant current in response to a second feedback signal, and a second color sensing unit measuring the second brightness of the second light and outputting the second feedback signal to the second constant current circuit, the second light being emitted in response to the second constant current.

In an exemplary embodiment of the present invention, the third driving part may include a second signal handling unit outputting a second white control signal in response to the reference control signal, a third constant current circuit outputting a third constant current having a third constant level in response to the second white control signal and maintaining the third constant level of the third constant current in response to a third feedback signal, and a third color sensing unit measuring the third brightness of the third light and outputting the third feedback signal to the third constant current circuit, the third light emitted in response to the third constant current.

According to another exemplary embodiment of the present invention, there is provided a backlight assembly including a first light emitting part emitting a first light having a first brightness in response to a brightness control signal and outputting a reference control signal, a second light emitting part emitting a second light having a second brightness controlled in response to the reference control signal, and a third light emitting part emitting a third light having a third brightness controlled in response to the reference signal.

In another exemplary embodiment of the present invention, the first light emitting part may include a first LED unit emitting the first light, a first constant current circuit supplying a first constant current having a first constant level to the first LED unit in response to the brightness control signal and a first feedback signal generated by a voltage applied to both ends of the first LED unit, and a first color sensing unit measuring the first brightness of the first light emitted in the first LED unit and outputting the reference control signal.

In another exemplary embodiment of the present invention, the second light emitting part may include a first signal handling unit outputting a first white control signal in response to the reference control signal, a second constant current circuit outputting a second constant current having a second constant level in response to the first white control signal and maintaining the second constant level of the second constant current in response to a second feedback signal, a second LED unit emitting the second light in response to the second constant current; and a second color sensing unit measuring the second brightness of the second light and outputting the second feedback signal to the second constant current circuit.

In another exemplary embodiment of the present invention, the third light emitting part may include a second signal handling unit outputting a second white control signal in response to the reference control signal, a third constant current circuit outputting a third constant current having a third constant level in response to the second white control signal and maintaining the third constant level of the third constant current in response to a third feedback signal, a third LED unit emitting the third light in response to the third constant current, and a third color sensing unit measuring the third brightness of the third light and outputting the third feedback signal to the third constant current unit.

In another exemplary embodiment of the present invention, the first light emitting part may include a red LED, the second light emitting part may include a green LED, and the third light emitting part may include a blue LED.

According to still another exemplary embodiment of the present invention, there is provided an LCD apparatus including an LCD panel including a first substrate having a thin film transistor ("TFT") array and a second substrate facing the first substrate and containing liquid crystal layer together with the first substrate, and a backlight assembly supplying a light having a predetermined brightness to the LCD panel, wherein the backlight assembly includes a first light emitting part emitting a first light having a first brightness in response to a brightness control signal and outputting a reference control signal, a second light emitting part emitting a second light having a second brightness controlled in response to the reference control signal, and a third light emitting part emitting a third light having a third brightness controlled in response to the reference signal.

In another exemplary embodiment of the present invention, the first light emitting part may include a red LED, the second light emitting part may include a green LED, and the third light emitting part may include a blue LED.

According to still another exemplary embodiment of the present invention, there is provided a method for driving a backlight including a first LED, a second LED and a third LED emitting a first light, a second light and a third light, respectively, the method including measuring a brightness of a selected one of the first, second and third lights, and determining a brightness of the other lights of the first, second and third lights proportional to the measured brightness of the selected one of the first, second and third lights.

In another exemplary embodiment of the present invention, the first LED may emit a red color light, the second LED may emit a green color light, and the third LED may emit a blue color light.

In another exemplary embodiment of the present invention, a constant current having a constant level may be continuously provided for each of the first, second and third LEDs.

According to still another exemplary embodiment of the present invention, there is provided a method for driving a backlight including a first light emitting part emitting a first light, a second light emitting part emitting a second light, and a third light emitting part emitting a third light, the method including driving the first light emitting part in response to a brightness control signal to emit the first light, measuring a first brightness of the first light to output a reference control signal corresponding to the first brightness of the first light, driving the second light emitting part in response to the reference control signal to emit the second light, and driving the third light emitting part in response to the reference control signal to emit the third light.

In another exemplary embodiment of the present invention, emitting the first light may include outputting a first constant current having a first constant level in response to the brightness control signal, driving a first light source included in the first light emitting part in response to the first constant current to emit the first light having a first brightness, and controlling the first brightness of the first light in response to a first feedback signal to constantly maintain the first brightness, the first feedback signal generated by a voltage applied to both ends of the first light emitting part.

In another exemplary embodiment of the present invention, outputting the reference control signal may include outputting a voltage proportional to the first brightness of the first light.

In another exemplary embodiment of the present invention, emitting the second light may include outputting a first white control signal determining a second brightness of the second light in response to the reference control signal, outputting a second constant current having a second constant level in response to the first white control signal and a second feedback signal, emitting the second light in response to the second constant current, and measuring the second brightness of the second light to emit the second feedback signal proportional to the second brightness of the second light.

In another exemplary embodiment of the present invention, emitting the third light may include outputting a second white control signal determining a third brightness of the third light in response to the reference control signal, outputting a third constant current having a third constant level in response to the second white control signal and a third feedback signal, emitting the third light in response to the third constant current, and measuring the third brightness of the third light to emit the third feedback signal proportional to the third brightness of the third light.

In another exemplary embodiment of the present invention, the first, second and third light emitting parts may include a first, second and third light source, respectively, emitting the first, second and third lights, respectively, and wherein a constant current having a constant level may be continuously provided for each of the first, second and third light sources.

In another exemplary embodiment of the present invention, the first light source may emit a red color light, the second light source may emit a green color light, and the third light source may emit a blue color light.

In another exemplary embodiment of the present invention, the first light source uses a red LED, the second light source uses a green LED, and the third light source uses a blue LED.

In the above-described device for driving the backlight, the backlight assembly, the LCD apparatus having the backlight assembly, and the method for driving the backlight, brightness of each color light of the backlight, which uses LEDs as light sources, is controlled using constant currents so that efficiency of the backlight may be improved and that brightness uniformity of the backlight may be maintained. Additionally, temperature of the backlight may be lowered and power consumption may be reduced.

BRIEF DESCRIPTION OF THE DRAWINGS

The above and other features and advantages of the present invention will become more apparent by describing detailed exemplary embodiments thereof with reference to the accompanying drawings, in which:

FIG. 6 is a table showing variations of white chromaticity coordinates, current and brightness corresponding to variation of a brightness control signal when an exemplary embodiment of a backlight assembly in accordance with the present invention is driven;

FIG. 7 is a table showing temperature and brightness characteristics corresponding to the surroundings of each of the backlight assemblies shown in FIGS. 1 and 2;

DETAILED DESCRIPTION OF THE INVENTION

Figure 1:
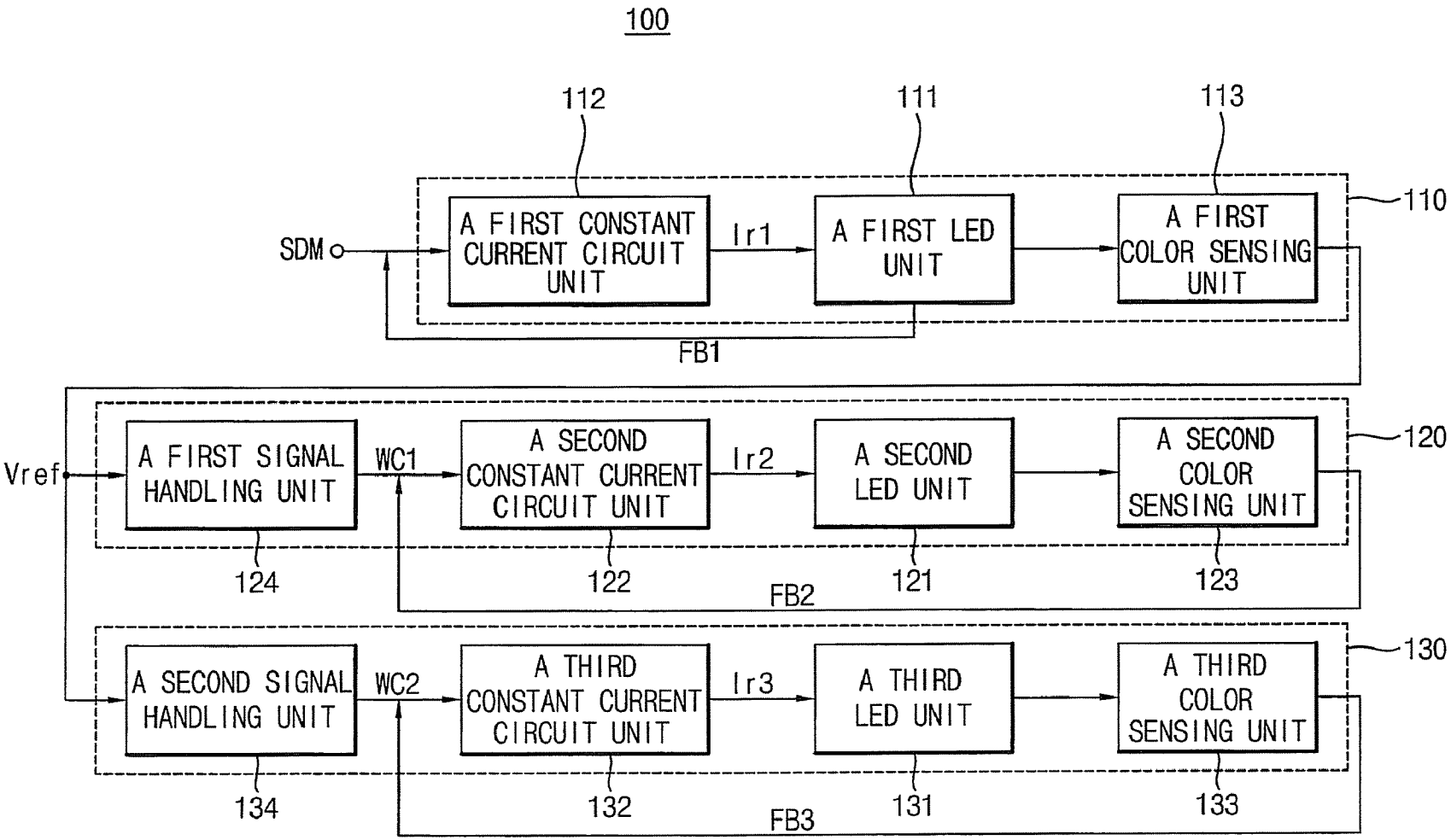
FIG. 1 is a block diagram illustrating an exemplary embodiment of a backlight assembly in accordance with the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-section illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
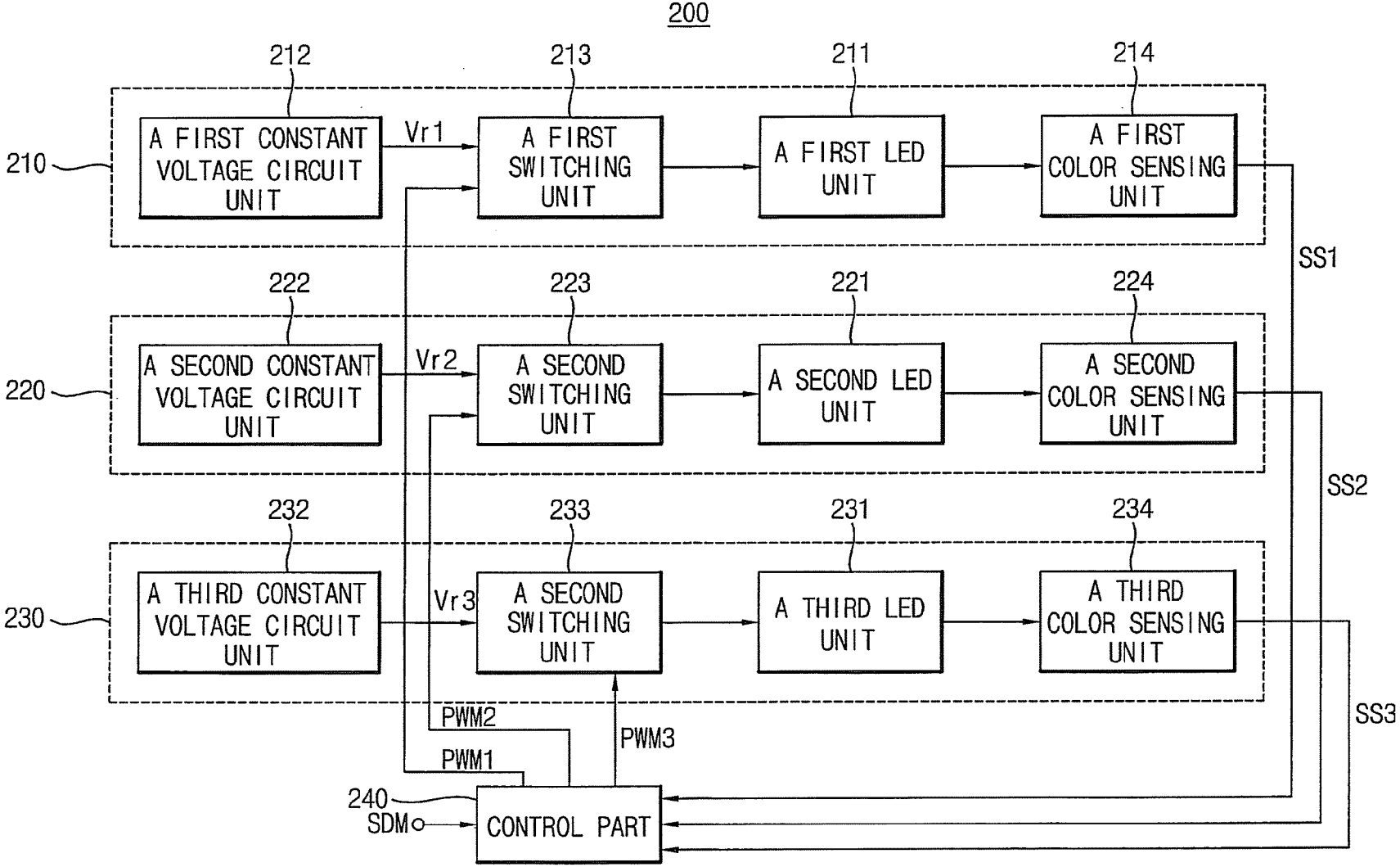
FIG. 2 is a block diagram illustrating a backlight assembly in accordance with a comparative example embodiment.
Figure 3A:
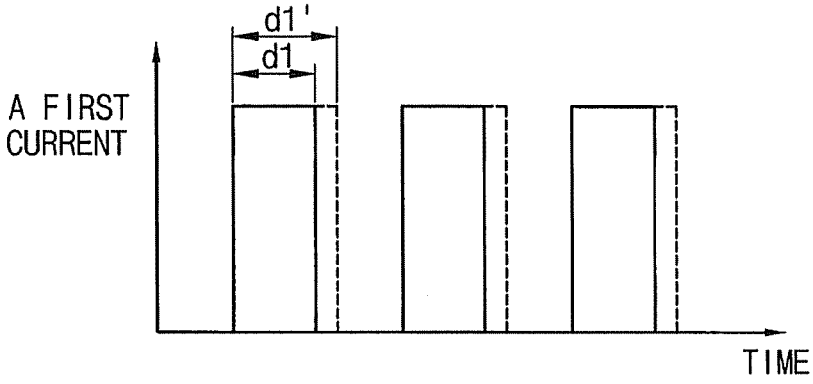
FIGS. 3A to 3C are graphs illustrating a method for controlling brightness of the comparative example backlight assembly shown in FIG. 2.
Figure 3B:
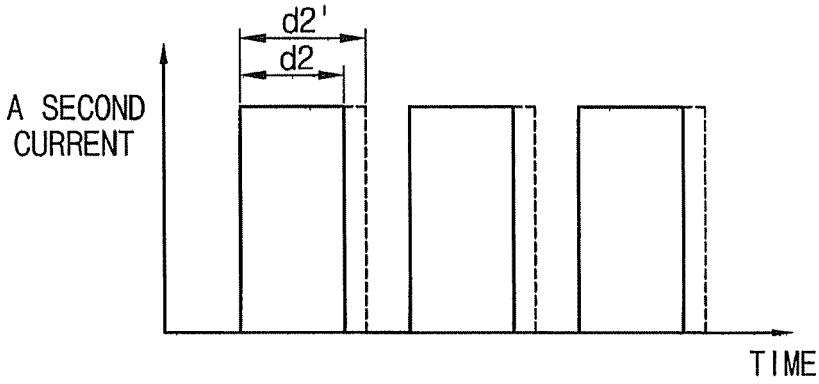
Figure 3C:
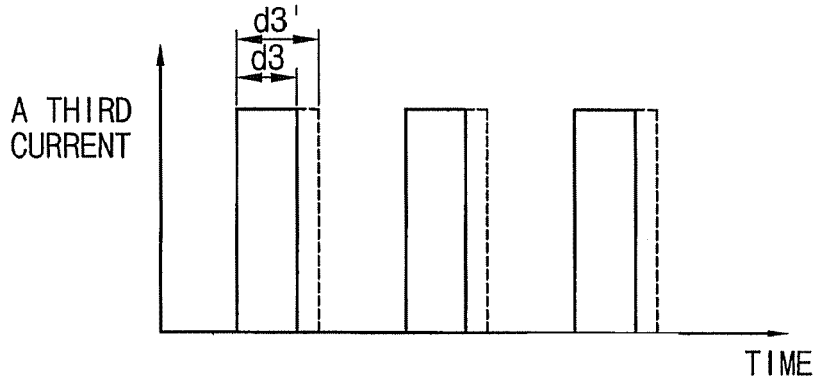
Figure 4:
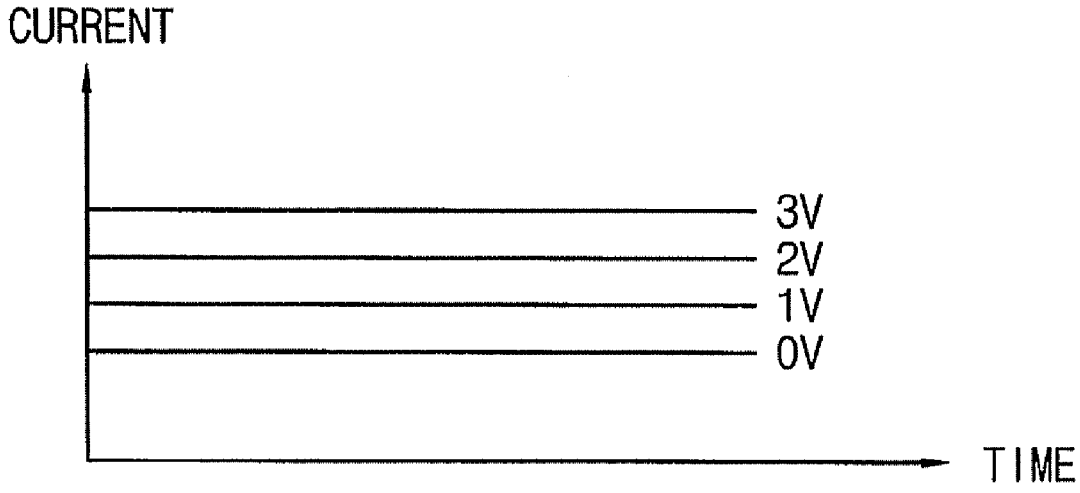
FIG. 4 is a graph illustrating an exemplary embodiment of a method for controlling the brightness of the exemplary embodiment of the backlight assembly shown in FIG. 1.

FIG. 1 is a block diagram illustrating an exemplary embodiment of a backlight assembly in accordance with the present invention. FIG. 2 is a block diagram illustrating a backlight assembly in accordance with a comparative example embodiment. FIGS. 3A to 3C are graphs showing a method for controlling brightness of the backlight assembly shown in FIG. 2. FIG. 4 is a graph showing an exemplary embodiment of a method for controlling the brightness of the exemplary embodiment of a backlight assembly shown in FIG. 1.

Referring to FIG. 2, a backlight 200 includes a first light emitting part 210 emitting a first color light, a second light emitting part 220 emitting a second color light, a third light emitting part 230 emitting a third color light, and a control part 240 controlling the light emitting time of each of the first, second and third light emitting parts 210, 220 and 230, respectively.

Particularly, the first light emitting part 210 has a first light emitting diode ("LED") unit 211, a first constant voltage circuit unit 212, a first switching unit 213, and a first color sensing unit 214.

The first LED unit 211 includes a plurality of first LEDs connected in series for emitting the first color light.

The first constant voltage circuit unit 212 generates a first constant voltage Vr1 having a constant potential level, and supplies the first constant voltage Vr1 to the first switching unit 213.

The first switching unit 213 switches to an on or off state in response to a first pulse width modulation signal PWM1 outputted from the control part 240, and when turned on supplies the first constant voltage Vr1 outputted from the first constant voltage circuit unit 212 to the first LED unit 211. The first LED unit 211 may be controlled by such an operation of the first switching unit 213 and the LED unit 211 emits light corresponding thereto.

The first color sensing unit 214 measures a brightness of a first light generated by the first LED unit 211, and outputs a first sensing signal SS1 having a potential level proportional to the brightness of the first light generated by the first LED unit 211 to the control part 240. That is, when the brightness of the first light is high, a first sensing signal SS1 having a high potential level may be outputted. On the contrary, when the brightness of the first light is low, a first sensing signal SS1 having a low potential level may be outputted.

The second light emitting part 220 has a second LED unit 221, a second constant voltage circuit unit 222, a second switching unit 223, and a second color sensing unit 224. The third light emitting part 230 has a third LED unit 231, a third constant voltage circuit unit 232, a third switching unit 233, and a third color sensing unit 234.

The second and third light emitting parts 220 and 230 have substantially the same structure as the first light emitting part 210, thus repetitive explanation about the second and third light emitting parts 220 and 230 will be omitted.

The second LED unit 221 includes a plurality of second LEDs which emit the second color light and which are connected in series. The third LED unit 231 includes a plurality of third LEDs which emit the third color light and which are connected in series. Additionally, the first, second and third color lights may be a red color light, a green color light and a blue color light, respectively.

The control part 240 outputs a pulse width modulation signal PWM (not shown) which controls driving of the first, second, and third LED units 211, 221, and 231 in response to a first sensing signal SS1, a second sensing signal SS2, and a third sensing signal SS3 outputted from the first, second, and third light emitting parts 210, 220, and 230 and a brightness control signal SDM.

The pulse width modulation signal PWM includes a first pulse width modulation signal PWM1, a second pulse width modulation signal PWM2 and a third pulse width modulation signal PWM3, each of which is provided to the first, second and third switching parts 213, 223 and 233. The pulse width modulation signal PWM controls the length of time for which constant voltages Vr1, Vr2 and Vr3 are provided to the first, second and third LED units 211, 221 and 231, respectively, by controlling activated time periods of the first, second and third switching units 213, 223 and 233. Accordingly, white chromaticity coordinates may be adjusted by controlling the brightness of the lights generated from the first, second and third LED units 211, 221 and 231.

Referring to FIGS. 2 to 3C, when the backlight 200 starts to operate, the control part 240 is provided with the brightness control signal SDM and supplies the first, second and third pulse width modulation signals PWM1, PWM2 and PWM3 to the first, second and third switching units 213, 223 and 233, respectively, so that the backlight 200 may project light having a first brightness indicated by the brightness control signal SDM.

Each of the first, second and third switching units 213, 223 and 233 is supplied with the first, second and third pulse width modulation signals PWM1, PWM2 and PWM3, respectively, by the control part 240. Each of the switching units then supplies the first, second and third constant voltages Vr1, Vr2 and Vr3 to the first, second and third LED units 211, 221 and 231, correspondingly. Each of the first, second and third color sensing units 214, 224 and 234 measures the first brightness of the lights generated from the first, second and third LED units 211, 221 and 231, respectively, and supplies the first, second and third sensing signals SS1, SS2 and SS3 to the control part 240.

The control part 240 adjusts a duty ratio of the pulse width modulation signal PWM to a desired value in accordance with the first brightness indicated by the brightness control signal SDM, so that each of the LED units 211, 221 and 231 may emit light having the first brightness indicated by the brightness control signal SDM.

When the brightness control signal SDM indicates a second brightness, the control part 240 adjusts the duty ratio of the pulse width modulation signal PWM to a desired value in accordance with the second brightness indicated by the brightness control signal SDM so that the first brightness may be changed while the white chromaticity coordinates are maintained. For example, as shown in FIGS. 3A to 3C, the control part 240 may change pulse widths of the first, second and third constant voltages Vr1, Vr2 and Vr3 from d1, d2 and d3 to d1', d2' and d3', respectively, in order to increase the first brightness.

As described in the background section above, a voltage control method, which controls the brightness of each of the first, second and third LED units 211, 221 and 231 and the white chromaticity coordinates by adjusting the pulse widths of the first, second and third constant voltages Vr1, Vr2 and Vr3 provided for each of the first, second and third LED units 211, 221 and 231, has inherent problems in that the red, green and blue LEDs included in each of the first, second and third LED units 211, 221 and 231 may deteriorate due to increases of the pulse widths and thus lifetime of the LEDs may be decreased.

Additionally, since the lifetime of the LEDs is reduced, the brightness of the backlight may rapidly decrease and thus the control part 240 will increase the pulse widths of the first, second and third constant voltages Vr1, Vr2 and Vr3 applied to the first, second and third switching units 213, 223 and 233, respectively. Thus, power consumption of the backlight will also increase.

Further, the above-mentioned deterioration and power consumption problems produce results that are part of a continuous feedback loop and thus a vicious cycle is set up where the decrease in the lifetime of the backlight and the deterioration of the brightness characteristics of the LEDs may be repeated. Because of the increase of the power consumption of the backlight, exothermic reactions, e.g., heating, may occur in parts of the backlight so that an additional means for heat protection may be required. Thus, manufacturing costs of the backlight and liquid crystal display ("LCD") apparatus having the backlight may increase.

Referring to FIG. 1, a backlight 100 in accordance with an exemplary embodiment of the present invention, includes a first light emitting part 110 emitting a first color light, a second light emitting part 120 emitting a second color light and a third light emitting part 130 emitting a third color light.

Particularly, the first light emitting part 110 has a first LED unit 111 and a first driving part which controls driving the first LED unit 111. The first driving part has a first constant current circuit unit 112 and a first color sensing unit 113.

The first LED unit 111 includes a plurality of first LEDs connected in series emitting the first color light. The first LED unit 111 generates the first color light having constant brightness by a first constant current Ir1 outputted from the first driving part.

The first constant current circuit unit 112 generates the first constant current Ir1 having a first constant current level in response to a brightness control signal SDM generated by an exterior device such as a host system (not shown), and supplies the first constant current Ir1 to the first LED unit 111. The first constant current circuit unit 112 outputs the first constant current Ir1 having a first constant current level proportional to a potential level of the brightness control signal SDM.

While the first constant current Ir1 is supplied to the first LED unit 111, a first feedback signal FB1, generated by voltage applied to both ends of the first LED unit 111, is provided to the first constant current circuit unit 112. The first constant current circuit unit 112 outputs the first constant current Ir1 in response to the brightness control signal SDM, and maintains the current at that level in response to the first feedback signal FB1 from the first LED unit 111. In this way the first constant current circuit unit 112 controls a first brightness of a first light generated by the first LED unit 111.

The first constant current circuit unit 112 may prevent the positive-feedback cycle of the comparative example embodiment of a backlight shown in FIG. 2. In the comparative example embodiment, when the backlight is used at high temperature or when the temperature of the backlight is high enough so that brightness characteristics of the backlight become deteriorated, the current is increased in order to compensate for that deterioration. However, the increased current causes increased deterioration, which in turn causes the current to increase yet again in a positive-feedback cycle. The positive-feedback cycle of the comparative example embodiment backlight may be prevented by an exemplary embodiment of the present invention, as shown in FIG. 4, because the first constant current circuit unit 112 outputs the first constant current Ir1 having the first constant current level proportional only to the potential level of the brightness control signal SDM even when the first brightness of the first light is deteriorated. FIG. 4 illustrates that the current remains constant over time for a given potential level of the brightness control signal. FIG. 4 particularly illustrates a brightness control signal with a potential level of 0-3 Volts. Thus, the deterioration of the brightness characteristic of the backlight, which is generated due to the high temperature of air or the backlight, may be prevented.

In an exemplary embodiment of the present invention, the first LED unit 111 includes a plurality of red LEDs, which are very sensitive to high temperature and thus are more sensitive to the deterioration of the brightness characteristic.

The first color sensing unit 113 measures the first brightness of the first light generated by the first LED unit 111, and outputs a reference control signal Vref having a predetermined level of voltage proportional to the first brightness of the first light. The reference control signal Vref is supplied to the second and the third light emitting parts 120 and 130 and is used to control brightness of lights generated by the second and third light emitting parts 120 and 130.

The second light emitting part 120 has a second LED unit 121 and a second driving unit which controls driving the second LED unit 121.

The second LED unit 121 includes a plurality of second LEDs connected in series and emitting the second color light. The second LED unit 121 generates the second color light having constant brightness by a second constant current Ir2 outputted from the second driving part.

The second driving part has a second constant current circuit unit 122, a second color sensing unit 123 and a first signal handling unit 124.

The second constant current circuit unit 122 generates the second constant current Ir2 having a second constant current level in response to a first white control signal WC1 outputted from the first signal handling unit 124, and supplies the second constant current Ir2 to the second LED unit 121.

When the second constant current Ir2 is supplied to the second LED unit 121, a second feedback signal FB2 outputted from the second color sensing unit 123 is provided for the second constant current circuit unit 122. The second constant current circuit unit 122 outputs the second constant current Ir2 in response to the first white control signal WC1, and maintains the second constant current level of the second constant current Ir2 in response to the second feedback signal FB2 from the second color sensing unit 123. Additionally, the second constant current circuit unit 122 outputs the second constant current Ir2 having the second constant current level proportional to a potential level of the first white control signal WC1 and thus controls a second brightness of a second light generated by the second LED unit 121.

The second color sensing unit 123 measures the second brightness of the second light generated by the second LED unit 121 in response to the first white control signal WC1, and outputs the second feedback signal FB2 having a predetermined level of voltage proportional to the second brightness of the second light.

In an exemplary embodiment of the present invention, the second LED unit 121 includes a plurality of green LEDs, which are less sensitive to high temperature than the red LED and thus are less sensitive to the deterioration of the brightness characteristic than the red LEDs.

The first signal handling unit 124 outputs the first white control signal WC1 in response to the reference control signal Vref.

While the first brightness of the first light generated by the first LED unit 111 is determined by the brightness control signal SDM, the first white control signal WC1 is determined to satisfy the white chromaticity coordinates condition. That is, the second color light, which is mixed with the first color light, is outputted so that the white chromaticity coordinates may be constantly maintained at the first brightness of the first light indicated by the brightness control signal SDM.

That is, the first white control signal WC1 is a signal which controls the second brightness of the second light using the first brightness of the first light as a reference brightness so that the backlight 100 may output brightness substantially the same as the first brightness indicated by the brightness control signal SDM. Additionally, the first white control signal WC1 is also a signal which controls the second brightness of the second light so that the white chromaticity coordinates may be constantly maintained.

The third light emitting part 130 has a third LED unit 131 and a third driving unit which controls driving the third LED unit 131.

The third LED unit 131 includes a plurality of the third LEDs connected in series emitting the third color light. The third LED unit 131 generates the third color light having constant brightness by a third constant current Ir3 outputted from the third driving part.

The third driving part has a third constant current circuit unit 132, a third color sensing unit 133 and a second signal handling unit 134.

The third constant current circuit unit 132 generates the third constant current Ir3 having a third constant current level in response to a second white control signal WC2 outputted from the second signal handling unit 134, and supplies the third constant current Ir3 to the third LED unit 131.

When the third constant current Ir3 is supplied to the third LED unit 131, a third feedback signal FB3 outputted from the third color sensing unit 133 is provided for the third constant current circuit unit 132. The third constant current circuit unit 132 outputs the third constant current Ir3 in response to the second white control signal WC2, and maintains the third constant current level of the third constant current Ir3 in response to the third feedback signal FB3 from the third color sensing unit 133. Additionally, the third constant current circuit unit 132 outputs the third constant current Ir3 having the third constant current level proportional to a potential level of the second white control signal WC2 and thus controls a third brightness of a third light generated by the third LED unit 131.

The third color sensing unit 133 measures the third brightness of the third light generated by the third LED unit 131 in response to the second white control signal WC2, and outputs the third feedback signal FB3 having a predetermined level of voltage proportional to the third brightness of the third light.

In an exemplary embodiment of the present invention, the third LED unit 131 includes a plurality of blue LEDs, which are less sensitive to high temperature than the red LED and thus are less sensitive to the deterioration of the brightness characteristic than the red LED.

The second signal handling unit 134 outputs the second white control signal WC2 in response to the reference control signal Vref.

When the first brightness of the first light generated by the first LED unit 111 is determined by the brightness control signal SDM, the second white control signal WC2 is determined to satisfy the white chromaticity coordinates condition. That is, the third color light, which is mixed with the first color light, is outputted so that the white chromaticity coordinates may be constantly maintained at the first brightness of the first light indicated by the brightness control signal SDM.

That is, the second white control signal WC2 is a signal which controls the third brightness of the third light with the first brightness of the first light as a reference brightness so that the backlight 100 may output brightness substantially the same as the first brightness indicated by the brightness control signal SDM. Additionally, the second white control signal WC2 is also a signal which controls the third brightness of the third light so that the white chromaticity coordinates may be constantly maintained.

Here, each of the first and second white control signals WC1 and WC2 maintains the white chromaticity coordinates with the first brightness of the first light as a reference brightness, and independently controls the second brightness and the third brightness, respectively, so that the backlight 100 may output brightness substantially the same as the first brightness indicated by the brightness control signal SDM. However, the first and second white control signals WC1 and WC2 are determined considering each other because the first, second and third lights are mixed to determine the white chromaticity coordinates.

Figure 5:
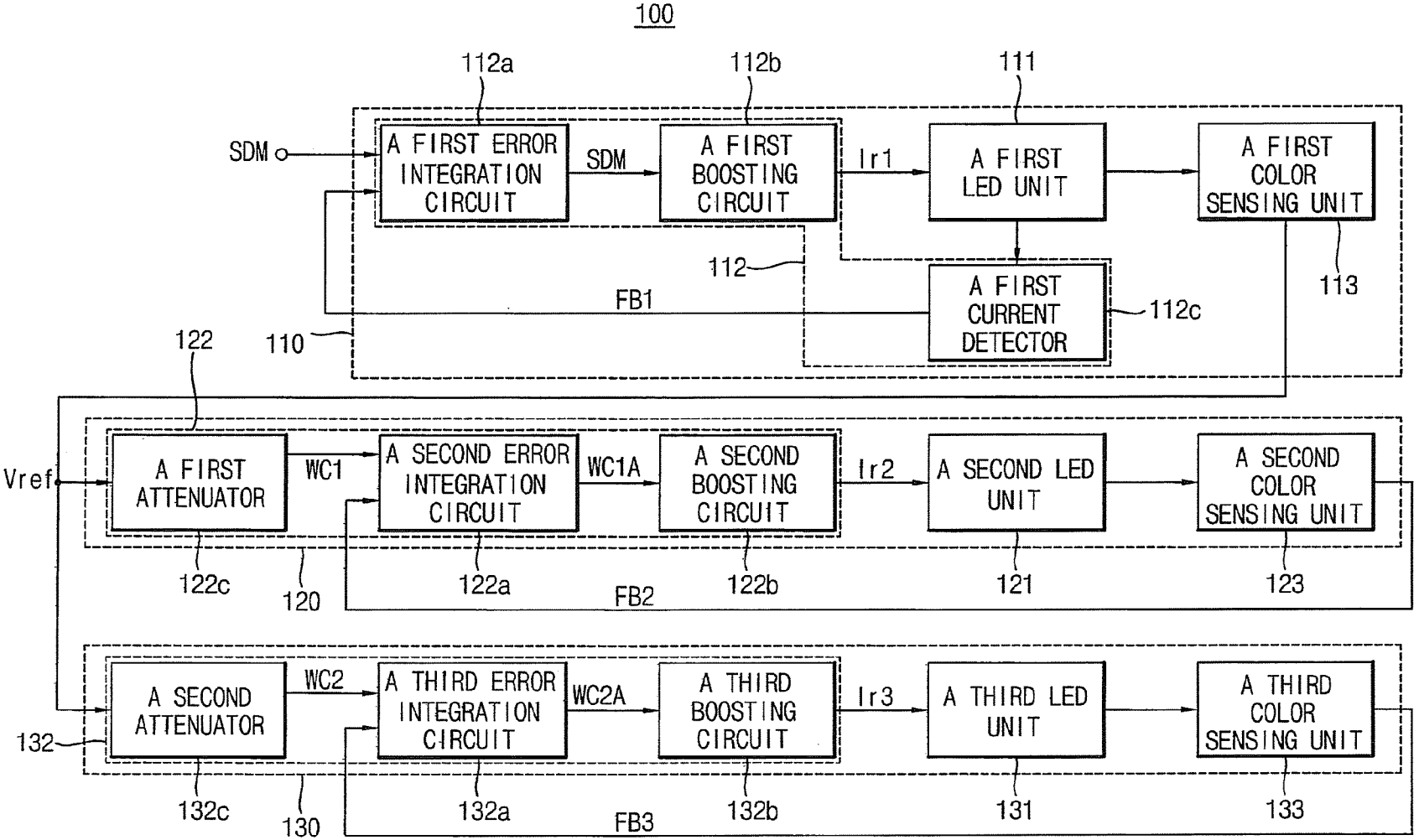
FIG. 5 is a block diagram illustrating the exemplary embodiment of the backlight assembly shown in FIG. 1 in further detail.

FIG. 5 is a block diagram illustrating the exemplary embodiment of a backlight assembly shown in FIG. 1 in further detail.

Referring to FIGS. 1 and 5, an exemplary embodiment of a backlight assembly 100 in accordance with the present invention, includes a first light emitting part 110 emitting a first color light, a second light emitting part 120 emitting a second color light and a third light emitting part 130 emitting a third color light.

Particularly, the first light emitting part 110 has a first LED unit 111 and a first driving part which controls driving the first LED unit 111.

The first LED unit 111 includes a plurality of first LEDs connected in series emitting the first color light. The first LED unit 111 generates the first color light having constant brightness by a first constant current Ir1 outputted from the first driving part.

The first driving part has a first constant current circuit unit 112 and a first color sensing unit 113. Referring to FIG. 5, the first constant current circuit unit 112 includes a first error integration circuit 112*a*, a first boosting circuit 112*b* and a current detector 112*c*.

The brightness control signal SDM is provided to the first error integration circuit 112*a*. After the first error integration circuit 112*a* stabilizes and corrects errors in the brightness control signal SDM, the first error integration circuit 112*a* supplies a brightness control signal SDM2 to the first boosting circuit 112*b*. The brightness control signal SDM2 may be modified from the brightness control signal SDM according to the error integration circuit.

The first error integration circuit 112*a* may contain an operational amplifier ("OP amp") having a feedback loop, which includes a feedback resistor connected to a negative input end. Alternative exemplary embodiments include configurations where the first error integration circuit 112*a* may be formed using other components.

The first boosting circuit 112*b* receives the brightness control signal SDM2 outputted from the first error integration circuit 112*a*, and supplies a first constant current Ir1 having a constant current level to the first LED unit 111 in response to a potential level of the brightness control signal SDM2.

The current detector 112*c* outputs a first feedback signal FB1 generated by voltage applied to both ends of the first LED unit 111. One exemplary embodiment of the current detector 112*c* may be formed using a group of resistors which have a predetermined resistance. The output of the current detector 112*c*, namely the first feedback signal FB1 generated by voltage applied to both ends of the first LED unit 111, is provided to the first error integration circuit 112*a*.

The first feedback signal FB1 is used to control the first boosting circuit 112*b* so that the first constant current Ir1 may maintain a desired value. The desired value is the first constant current Ir1 outputted from the first boosting circuit 112*b* in response to the brightness control signal SDM2.

Accordingly, the first boosting circuit 112*b* supplies the first constant current Ir1, maintained as the desired value, to the first LED unit 111, and the first constant current Ir1 having the desired value is continuously supplied to the first LED unit 111 so that a first brightness of the first light generated by the first LED unit 111 may be constantly maintained.

That is, the first brightness of the first light generated by the first LED unit 111 is controlled by a current control method so that the first LED unit 111 is continuously driven. Therefore, malfunctions such as non-uniformity problems generated when the first brightness is controlled by a voltage control method in which the time for light emission is controlled by a pulse width of the applied voltage may be reduced, or effectively prevented.

The first color sensing unit 113 measures the first brightness of the first light generated by the first LED unit 111, and outputs a reference control signal Vref having a predetermined level of voltage proportional to the first brightness of the first light. The reference control signal Vref is supplied to the second and third light emitting parts 120 and 130 and is used to control the brightness of the lights they generate.

The second light emitting part 120 has a second LED unit 121 and a second driving part which controls driving the second LED unit 121.

The second LED unit 121 may include a plurality of second LEDs connected in series and emitting the second color light. The second LED unit 121 generates the second color light having constant brightness by a second constant current Ir2 outputted from the second driving part.

The second driving part has a second constant current circuit unit 122 and a second color sensing unit 123.

The second constant current circuit unit 122 includes a second error integration circuit 122*a*, a second boosting circuit 122*b* and a first attenuator 122*c*.

Each of the second error integration circuit 122*a* and the second boosting circuit 122*b* has substantially the same structure as the first error integration circuit 112*a* and the first boosting circuit 112*b*, respectively. Thus, repetitive explanation about the second error integration circuit 122*a* and the second boosting circuit 122*b* will be omitted.

The first attenuator 122*c* outputs a first white control signal WC1 in response to the reference control signal Vref supplied by the first color sensing unit 113 included in the first light emitting part 110.

The first attenuator 122*c* may control a second brightness of a second light in response to a voltage level of the reference control signal Vref. An exemplary embodiment of the first attenuator may be formed using a group of resistors in order to output the first white control signal WC1. The first white control signal WC1 may have a predetermined potential level by which the white chromaticity coordinates may be constantly maintained. Thus, the first attenuator 122*c* supplies the first white control signal WC1 having the determined potential level in response to the reference control signal Vref to the second error integration circuit 122*a*.

When the first white control signal WC1 is supplied to the second error integration circuit 122*a*, a second feedback signal FB2 having a predetermined potential level outputted from the second color sensing unit 123 is also supplied to the second error integration circuit 122*a*.

The second feedback signal FB2 is used to control the second boosting circuit 122*b* so that the second constant current Ir2 may maintain a desired value. The desired value is the second constant current Ir2 outputted from the second boosting circuit 122*b* in response to a first white control signal WC1A outputted from the second error integration circuit 122*a*. The first white control signal WC1A may be modified from the first white control signal WC1 according to the second error integration circuit 122*a*, Accordingly, the second boosting circuit 122*b* supplies the second constant current Ir2 which is maintained as the desired value to the second LED unit 121. The second constant current Ir2 having the desired value is continuously supplied to the second LED unit 121 so that a second brightness of the second light generated by the second LED unit 121 may be constantly maintained.

That is, the second brightness of the second light generated by the second LED unit 121 is controlled by a current control method so that the second LED unit 121 is continuously driven. Therefore, malfunctions such as non-uniformity problems generated when the second brightness is controlled by a voltage control method in which the time for light emission is controlled by a pulse width of the applied voltage may be reduced or effectively prevented. Additionally, light emitting efficiency of the backlight 100 in accordance with an exemplary embodiment of the present invention may be increased compared to a conventional backlight using the voltage control method because small current is continuously used to drive the first, second and third light emitting parts 110, 120 and 130.

The third light emitting part 130 has a third LED unit 131 and a third driving part which controls driving the third LED unit 131.

The third LED unit 131 may include a plurality of third LEDs connected in series and emitting the third color light. The third LED unit 131 generates the third color light having constant brightness by a third constant current Ir3 outputted from the third driving part.

The third driving part has a third constant current circuit unit 132 and a third color sensing unit 133.

The third constant current circuit unit 132 includes a third error integration circuit 132*a*, a third boosting circuit 132*b* and a second attenuator 132*c*.

The third light emitting part 130 has substantially the same structure as the second light emitting part 120, and performs substantially the same function as the second light emitting part 120. Thus, repetitive explanation about the third light emitting part 130 will be omitted.

FIG. 6 is a table showing variations of white chromaticity coordinates, current and brightness relative to a variation of the brightness control signal SDM when an exemplary embodiment of a backlight in accordance with the present invention is driven.

Referring to FIGS. 5 and 6, the exemplary embodiment of a backlight 100 in accordance with the present invention is set to emit light having a brightness as shown in the table in response to a potential level of the brightness control signal SDM, e.g., a potential level in a range of about 0 V to about 4 V which is supplied from an exterior system such as a host system having an LCD apparatus.

When the brightness control signal SDM, for example, has a potential level of about 2 V, the first boosting circuit 112*b* applies a first constant current Ir1 of about 59 mA to the LED included in the first LED unit 111, and the first attenuator 122*c* outputs a first white control signal WC1 having a predetermined level of voltage in order to maintain a brightness of about 179 nit and a predetermined level of white chromaticity coordinates which are proportional to the first brightness of the first light generated by the LED included in the first LED unit 111 in response to the first constant current Ir1. In one exemplary embodiment the LED included in the first LED unit 111 may be red.

The second boosting circuit 122*b* supplies a second constant current Ir2 of about 73 mA to the LED included in the second LED unit 121. In one exemplary embodiment the LED included in the second LED unit 121 may be green.

The second attenuator 132*c* outputs a second white control signal WC2 having a predetermined level of voltage in order to maintain the brightness of about 179 nit and the predetermined level of white chromaticity coordinates which are proportional to the first brightness of the first light generated by the LED included in the first LED unit 111 in response to the first constant current Ir1.

The third boosting circuit 132*b* supplies a third constant current Ir3 of about 47 mA to the LED included in the third LED unit 131. According to one exemplary embodiment the LED included in the third LED unit 131 may be blue.

That is, the first brightness of the first light generated by the first LED unit 111 is changed accordingly as a current level of the first constant current Ir1 is changed in response to the potential level of the brightness control signal SDM. Additionally, the second brightness of the second light generated by the second LED unit 121 and the third brightness of the third light generated by the third LED unit 131 are changed accordingly as the potential levels of the first and the second control signals WC1 and WC2 are changed, respectively, in response to the first brightness of the first light generated by the first LED unit 111.

Thus, the first brightness of the first LED unit 111 is controlled by the first constant current Ir1 having a first current level outputted by the brightness control signal SDM. The second brightness of the second LED unit 121 and the third brightness of the third LED unit 131 are controlled by the second and third constant currents Ir2 and Ir3. The second and third constant currents Ir2 and Ir3 having a second current level and a third current level, respectively, in response to the first brightness of the first LED unit 111 having a predetermined level outputted by the first constant current Ir1.

Briefly, the first current level of the first constant current Ir1 is changed by the brightness control signal SDM. This change in the first constant current Ir1 controls the first brightness of the first LED unit 111. Additionally, the second and third current levels of the second and third constant currents Ir2 and Ir3 applied to the second and third LED units 121 and 131, respectively, are changed in response to the first brightness of the first LED unit 111. These changes in the second and third current levels of the second and third constant currents Ir2 and Ir3 control the second brightness of the second LED unit 121 and the third brightness of the third LED unit 131 respectively.

The backlight 100 may have a high light emitting efficiency because the first, second and third constant currents Ir1, Ir2 and Ir3 having the first, second and third current levels, respectively, are continuously provided to the first, second and third LED units 111, 121 and 131, respectively, when the backlight 100 is operating.

When the voltage control method of the comparative example embodiment is used, a current peak value is determined according to the duty ratio of a pulse width of an applied voltage. However, when the exemplary embodiment of a current control method, of the present invention is used, such as in the backlight 100, a constant current having a low level is continuously provided so that the backlight 100 may have a high light emitting efficiency.

Additionally, in the exemplary embodiment of a current control method, the LED units 111, 112 and 113 continuously operate so that a flicker phenomenon may not be generated. Therefore, a malfunction or problem of brightness non-uniformity may be reduced or effectively prevented.

FIG. 7 is a table showing temperature and brightness characteristics according to the surroundings of each of the backlight assemblies shown in FIGS. 1 and 2, i.e., an exemplary embodiment of a backlight assembly according to the present invention and a comparative example embodiment of a backlight assembly, respectively.

Experimental data shown in FIG. 7 was obtained using substantially the same number of LEDs in both the exemplary current control method and the conventional voltage control method. The backlight assembly using the voltage control method used a graphite plate as a means for heat protection, and the backlight assembly in the exemplary embodiment of a current control method did not use any means for heat protection.

Referring to FIG. 7, when the exemplary embodiment of a backlight assembly using the current control method of the present invention projected light having a brightness of about 260 nit, power consumption was about 50 W. However, when the backlight assembly using the voltage control method projected light having a brightness of about 255 nit, the power consumption was about 89 W. Thus, the light emitting efficiency of the backlight assembly using the exemplary current control method was greater than that of the backlight assembly using the conventional voltage control method.

Additionally, when operated at a normal ambient temperature, the backlight assembly using the exemplary current control method had superior temperature characteristics as measured in the proximity of an LED bar, inside and outside of a panel and on a rear face of the backlight assembly when compared to the backlight assembly using the voltage control method of the comparative example embodiment, as shown in FIG. 7.

Furthermore, when operating at a high ambient temperature of about 50° C., the exemplary embodiment of a backlight assembly using the exemplary current control method of the present invention had a brightness of about 215 nit and the backlight assembly using the voltage control method of the comparative example embodiment had a brightness of about 222 nit. Brightness characteristics of both the backlight assemblies were deteriorated. However, power consumption of the exemplary embodiment of a backlight assembly using the current control method at the high temperature was similar to that at normal temperature. The backlight using the conventional voltage control method increased power consumption to improve the deteriorated brightness characteristic. Thus the LEDs of the comparative example embodiment deteriorate more rapidly and the lifetime of the LEDs is reduced.

Additionally, the exemplary embodiment of a backlight assembly using the exemplary current control method has good temperature characteristics even at high temperatures as measured in the LED bar, inside and outside of the panel and the rear face of the backlight assembly, even without the graphite plate.

Figure 8:
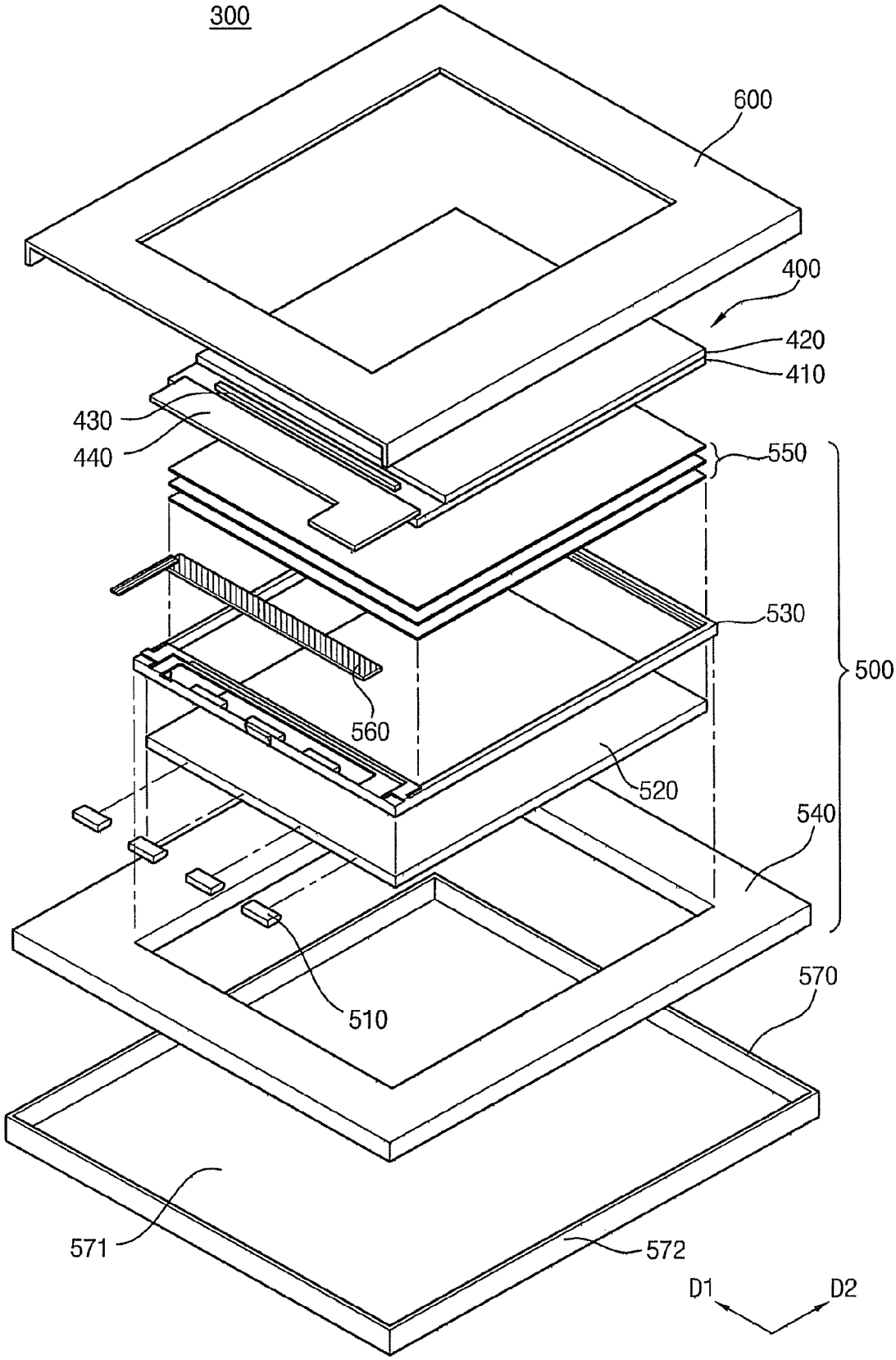
FIG. 8 is an exploded perspective view illustrating an exemplary embodiment of an LCD apparatus in accordance with the present invention.

FIG. 8 is an exploded perspective view illustrating an exemplary embodiment of an LCD apparatus in accordance with the present invention.

Referring to FIG. 8, an exemplary embodiment of an LCD apparatus 300 in accordance with the present invention includes an LCD panel 400 and a backlight assembly 500 supplying light having a predetermined brightness.

The LCD panel 400 has a first substrate 410, a second substrate 420 facing the first substrate 410, and a liquid crystal layer (not shown) interposed between the first and second substrates 410 and 420.

Particularly, the first substrate 410 includes a plurality of pixels arranged in a matrix configuration. Each of the plurality of the pixels includes a gate line extending in a first direction D1 and a data line extending in a second direction D2 substantially perpendicular to the first direction D1. The data line is intersects the gate line and is insulated therefrom. Additionally, each of the pixels includes a thin film transistor ("TFT") which is connected to both the gate line and the data line.

A gate driving chip or a data driving chip 430, which supplies a driving signal to the gate line and the date line, may be mounted on an end portion of the first substrate 410. The gate driving chip or the data driving chip 430 may include two or more chips one of which is used for the gate line and one of which is used for the data line. Alternatively, the gate driving chip or the data driving chip 430 may include one chip used for both the gate line and the data line. The gate driving chip or the data driving chip 430 may be mounted on the end portion of the first substrate 410 by a chip on glass ("COG") process.

The LCD panel 400 further has a first flexible printed circuit board ("PCB") 440 attached to the end portion of the first substrate 410. The first flexible PCB 440 supplies a control signal to the gate driving chip or the data driving chip 430. A timing controller for controlling a length of time a driving signal lasts or a memory device for storing a data signal may be mounted on the first flexible PCB 440. The first flexible PCB 440 may be electrically connected to the first substrate 410 through an anisotropic conductive film (not shown).

The light source assembly 500 includes a light source 510, a light guide plate 520, a mold frame 530, a printed circuit board ("PCB") 540, optical sheets 550 and a receiving container 570.

The light source 510 generates light having a predetermined brightness. The light source 510 may use a plurality of LEDs for generating the light including a first LED emitting a first light having a first color, a second LED emitting a second light having a second color, and a third LED emitting a third light having a third color. The light source 510 may combine these three colors in order to create a natural appearing white light. In an exemplary embodiment of the present invention, each of the first, second and third LEDs generate red color light, green color light and blue color light, respectively. Each of the first, second and third LEDs may include a plurality of sub-LEDs. The chromaticity of the light projected from the light source 510 may be adjusted by controlling brightness of each of the first, second and third lights generated by the first second and third LEDs, respectively.

The light guide plate 520 has a light incident face and a light exit face. The light incident face may be formed at one side or both sides of the light guide plate 520, and the light exit face may be formed at an upper side or a lower side of the light guide plate 520. The light source 510 is disposed outside the light guide plate 520 near the light incident face. Light generated by the light source 510 is transmitted to the light guide plate 520 through the light incident face, and exits from the light guide plate 520 through the light exit face.

The mold frame 530 receives the light source 510 and the light guide plate 520. The mold frame 530 receives the light source 510 in additional space formed at one side or both sides of the light guide plate 520. The optical sheets 550 may be inserted in the mold frame 530 to be supported by the light guide plate 520. The second flexible PCB 560, which applies a driving source to the light source 510, may be mounted on the mold frame 530.

The PCB 540 includes circuit patterns forming transmission paths for a source voltage and control signals for driving the light source 510. The circuit patterns may be formed on a multilayer PCB, and the driving chip and peripheral circuit elements may be mounted on the top layer of the multi layer PCB. The PCB 540 may be connected to the light source 510 through the second flexible PCB 560, and applied the driving source provided from outside and control signals provided from the driving chip to the light source 510.

The PCB 540 includes a first driving part for driving a first LED unit, a second driving part for driving a second LED unit, and a third driving part for driving a third LED unit as described above. Repetitive explanation about the first, second and third driving parts will be omitted.

The optical sheets 550 are disposed over the light guide plate 520, and improve the brightness characteristics of light by diffusing or concentrating the light which is transmitted through the light guide plate 520. In an exemplary embodiment of the present invention, the optical sheets 550 may include a diffusing sheet improving the brightness characteristics of the light by diffusing the light exiting from the light guide plate 520.

The receiving container 570 includes a bottom portion 571 and a side portion 572, which extends from an edge of the bottom portion 571 in a direction substantially perpendicular to the bottom portion 571. The bottom portion 571 and the side portion 572 together define a receiving space. The light source 510, the light guide plate 520, the mold frame 530, the PCB 540 and the optical sheets 550 may be contained in the receiving space made by the receiving container 570.

In an exemplary embodiment of the present invention, the LCD apparatus 300 may further include a top chassis 600. The top chassis 600 may be coupled with the receiving container 570 to cover a display area of the LCD panel 400. The top chassis 600 prevents damage to the LCD panel generated from exterior impacts, and prevents the LCD panel from leaving the receiving container 570.

Figure 9:
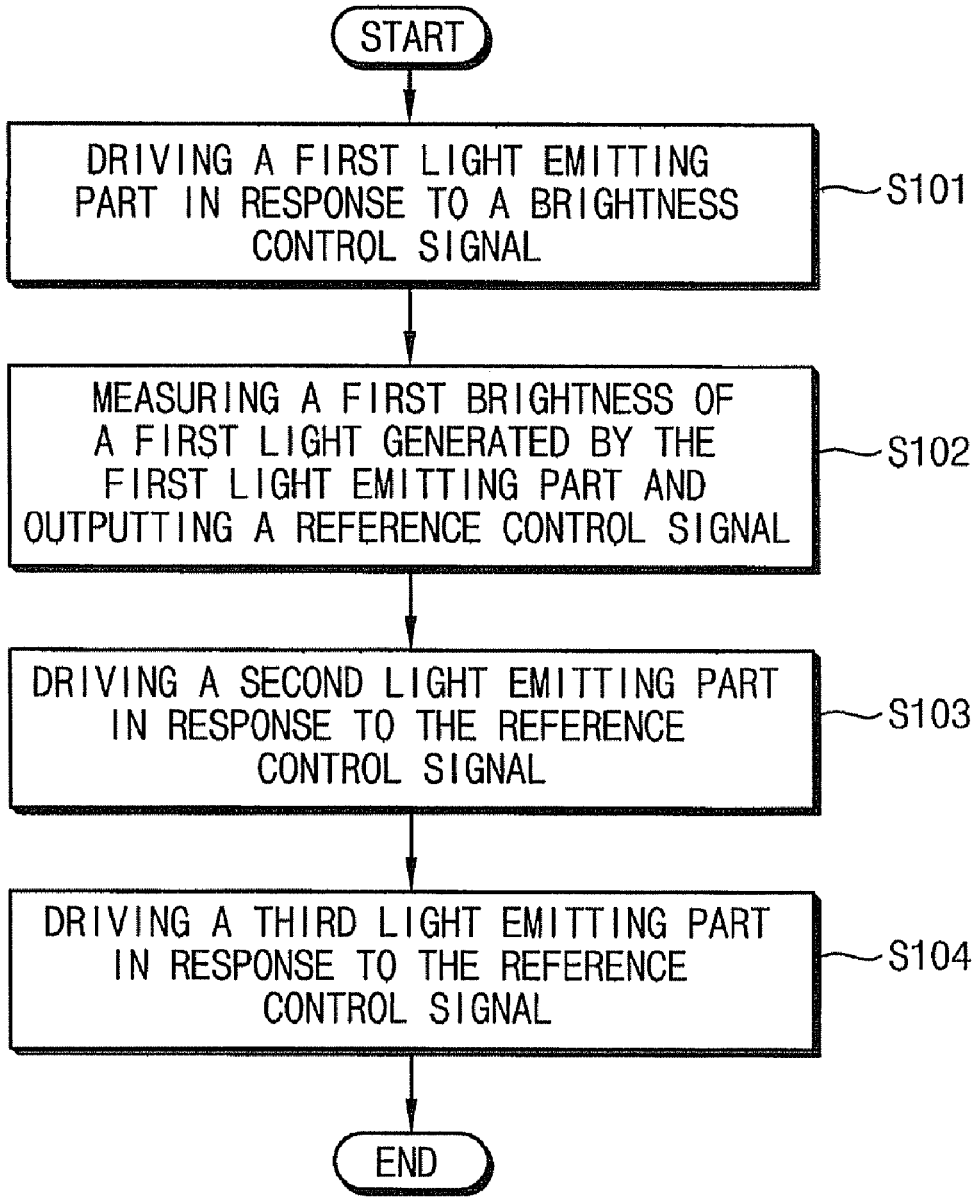
FIG. 9 is a flow chart illustrating an exemplary embodiment of a method for driving a backlight according to the present invention.

FIG. 9 is a flow chart illustrating an exemplary embodiment of a method for driving a backlight of the present invention. It will be understood that, although the term "step" may be used herein to describe an element of the method for driving a backlight, the present invention should not be limited by this term and/or order of the steps introduced. The term "step" is only used to distinguish one element of the method from another element. Thus, a reference numeral associated with a step discussed below could be termed with another reference numeral without departing from the teachings of the present invention.

Referring to FIGS. 5 and 9, the method for driving a backlight includes: a step S101 of driving a first LED part in response to a brightness control signal SDM; a step S102 of measuring a first brightness of a first light generated by the first LED part and outputting a reference control signal Vref; a step S103 of driving a second LED part in response to the reference control signal Vref; and a step S104 of driving a third LED part in response to the reference control signal Vref.

The step S101 includes emitting the first light having the first brightness and constantly maintaining that brightness.

More particularly, the brightness control signal SDM outputted from an exterior system such as a host system is inputted to a first error integration circuit 112*a*. A first boosting circuit 112*b* supplies a first constant current Ir1 having a first constant current level to a first LED unit 111 in response to a potential level of the brightness control signal SDM2 outputted from the first error integration circuit 112*a* to emit the first light having a first color.

When a first feedback signal FB1 determined by a voltage applied to both ends of the first LED unit 111 is outputted from a current detector 112*c*, the first feedback signal FB1 is supplied to the first error integration circuit 112*a*. The first error integration circuit 112*a* outputs a brightness control signal SDM2 determined by the first feedback signal FB1 and the brightness control signal SDM. The brightness control signal SDM2 is supplied to the first boosting circuit 112*b*. The first boosting circuit 112*b* controls the first constant current Ir1 in response to the brightness control signal SDM2 and maintains the current at the value indicated by the brightness control signal SDM.

In the step S102, a first color sensing unit 113 measures the first brightness of the first light, and outputs the reference control signal Vref proportional to the first brightness of the first light. When the first brightness of the first light is high, a reference control signal Vref having a high potential level may be outputted. Alternatively, when the brightness of the first light is low, a reference control signal Vref having a low potential level may be outputted.

The step S103 includes outputting a first white control signal WC1, outputting a second constant current Ir2 having a second constant current level, emitting a second light having a second color, and measuring a second brightness of the second light to output a second feedback signal FB2.

More particularly, a first attenuator 122*c* outputs the first white control signal WC1 in response to the reference control signal Vref. The first white control signal WC1 is the current necessary to be supplied to the second light to have the second brightness in response to the reference control signal Vref For example, the first brightness of the first light, and simultaneously the second brightness of the second light are controlled so that white chromaticity coordinates may be constantly maintained when the first and second lights having the first and second colors are mixed.

As the first white control signal WC1 is inputted to a second error integration circuit 122*a*, a second boosting circuit 122*b* generates the second constant current Ir2 having the second constant current level in response to the first white control signal WC1A outputted from the second error integration circuit 122*a*, and supplies the second constant current Ir2 to a second LED unit 121.

When the second feedback signal FB2 outputted from a second color sensing unit 123 is supplied to the second error integration circuit 122*a*, the second boosting circuit 122*b* controls the second constant current Ir2 to maintain a desired value. That desired value is a current value indicated by the first white control signal WC1A outputted from the second error integration circuit 122*a*.

The second boosting circuit 122*b* supplies the second constant current Ir2 having the second constant current level to the second LED unit 121 in response to the first white control signal WC1A, which is generated by the second error integration circuit 122*a* and incorporates the first white control signal WC1 and a potential level of the second feedback signal FB2, so that the second LED unit 121 generates the second light having the second color.

The second color sensing unit 123 measures the second brightness of the second light, and outputs the second feedback signal FB2 having the potential level proportional to the second brightness of the second light to supply the second feedback signal FB2 to the second error integration circuit 122*a*. The second feedback signal FB2 is supplied to the second boosting circuit 122*b* together with the first white control signal WC1 through the second error integration circuit 122*a*.

The step S104 includes outputting a second white control signal WC2, outputting a third constant current Ir3 having a third constant current level, emitting a third light having a third color, and measuring a third brightness of the third light to output a third feedback signal FB3.

More particularly, a second attenuator 132*c* outputs the second white control signal WC2 in response to the reference control signal Vref. The second white control signal WC2 is the current necessary to be supplied to the third light to have the third brightness in response to the reference control signal Vref. For example the first brightness of the first light, and simultaneously the third brightness of the third light are controlled so that white chromaticity coordinates may be constantly maintained when the first and third lights having the first and third colors are mixed.

As the second white control signal WC2 is inputted to a third error integration circuit 132*a*, a third boosting circuit 132*b* generates the third constant current Ir3 having the third constant current level in response to the second white control signal WC2A outputted from the third error integration circuit 122*a*, and supplies the third constant current Ir2 to a third LED unit 121. The second white control signal WC2A may be modified from the second white control signal WC2 according to the second error integration circuit 122*a*. When the third feedback signal FB3 outputted from a third color sensing unit 133 is supplied to the third error integration circuit 132*a*, the third boosting circuit 132*b* controls the third constant current Ir3 to maintain a desired value. That desired value is a current value indicated by the second white control signal WC2A outputted from the third error integration circuit 132*a*.

The third boosting circuit 132*b* supplies the third constant current Ir3 having the third constant current level to the third LED unit 131 in response to the second white control signal WC2A, which is generated by the third error integration circuit 123*a* and incorporates the second white control signal WC2 and a potential level of the third feedback signal FB3, so that the third LED unit 131 generates the third light having the third color.

The third color sensing unit 133 measures the third brightness of the third light, and outputs the third feedback signal FB3 having the potential level proportional to the third brightness of the third light to supply the third feedback signal FB3 to the third error integration circuit 132*a*. The third feedback signal FB3 is supplied to the third boosting circuit 132*b* together with the second white control signal WC2A through the third error integration circuit 132*a*.

In the above-described exemplary embodiment of a method for driving a backlight in accordance with the present invention, the brightness control signal SDM is provided for the first light emitting part 110, the first constant current Ir1 having the first constant current level is provided for the first LED unit 111 included in the first light emitting part 110 in response to the brightness control signal SDM, and the second brightness and the third brightness of the second and third lights, respectively, are controlled using the first brightness of the first light as a reference brightness. However, alternative exemplary embodiments include configurations where the brightness control signal SDM may be provided for the second or third light emitting parts 120 or 130. Thus, for example, when the brightness control signal SDM is provided for the second light emitting part 120, the first brightness and the third brightness may be controlled using the second brightness as a reference brightness.

In another exemplary embodiment of the present invention, the brightness control signal SDM is provided for a light emitting part including LEDs having a color which is more prone to deterioration in order to improve lifetime of the backlight.

For example, when red, green and blue LEDs are included in the first, second and third light emitting parts 110, 120 and 130, respectively, a brightness control signal SDM is provided for the first light emitting part 110 which includes the more fragile red LEDs, and the second brightness and the third brightness of the second and third light emitting parts 120 and 130, respectively, are controlled using the first brightness of the first light as a reference brightness.

According to another exemplary embodiment of the present invention, a backlight is driven by a current control method in which a red LED, which is prone to deterioration is provided with a first constant current having a constant current level in response to a brightness control signal to emit a light, and a green LED and a blue LED are provided with the second and the third constant currents, respectively, in order to maintain white chromaticity coordinates in response to brightness of the red LED. Thus, efficiency of the backlight may be improved, uniformity of brightness may be maintained, and temperature and power consumption of the backlight may be reduced.

Additionally, a current having a constant current level regardless of environmental temperature may be applied to a heat sensitive red LED, and currents applied to a green LED and a blue LED may be controlled so that lifetimes of the LEDs and the backlight may be improved.

The foregoing exemplary embodiments are illustrative of the present invention and are not to be construed as limiting thereof. Although a few exemplary embodiments of the present invention have been described, those skilled in the art will readily appreciate that many modifications are possible in the exemplary embodiments without materially departing from the novel teachings and advantages of the present invention. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method for driving a backlight including a first light emitting part emitting a first light, a second light emitting part emitting a second light, and a third light emitting part emitting a third light, the method comprising:

driving the first light emitting part in response to a brightness control signal to emit the first light;

measuring a first brightness of the first light to output a reference control signal corresponding to the first brightness of the first light;

driving the second light emitting part in response to the reference control signal to emit the second light; and driving the third light emitting part in response to the reference control signal to emit the third light, wherein each of the first, second and third light emitting parts is driven by a constant current having a constant level.

2. The method of claim 1, wherein emitting the first light comprises:

outputting a first constant current having a first constant level in response to the brightness control signal;

driving a first light source included in the first light emitting part in response to the first constant current to emit the first light having a first brightness; and controlling the first brightness of the first light in response to a first feedback signal to constantly maintain the first brightness, the first feedback signal generated by a voltage applied to both ends of the first light emitting part.

3. The method of claim 1, wherein outputting the reference control signal comprises outputting a voltage proportional to the first brightness of the first light.

4. The method of claim 1, wherein emitting the second light comprises:

outputting a first white control signal determining a second brightness of the second light in response to the reference control signal;

outputting a second constant current having a second constant level in response to the first white control signal and a second feedback signal;

emitting the second light in response to the second constant current; and measuring the second brightness of the second light to emit the second feedback signal proportional to the second brightness of the second light.

5. The method of claim 1, wherein emitting the third light comprises:

outputting a second white control signal determining a third brightness of the third light in response to the reference control signal;

outputting a third constant current having a third constant level in response to the second white control signal and a third feedback signal;

emitting the third light in response to the third constant current; and measuring the third brightness of the third light to emit the third feedback signal proportional to the third brightness of the third light.

6. The method of claim 1, wherein the first, second and third light emitting parts comprise a first, second and third light source, respectively, wherein the first, second and third light sources emit the first, second and third lights, respectively, and wherein the constant current having the constant level is continuously provided for each of the first, second and third light sources.

7. The method of claim 6, wherein the first light source emits a red color light, wherein the second light source emits a green color light, and wherein the third light source emits a blue color light.

8. The method of claim 7, wherein the first light source uses a red light emitting diode, the second light source uses a green light emitting diode, and third light source uses a blue light emitting diode.

* * * * *